United States Patent [19]

Peters et al.

[11] Patent Number: 5,017,035

[45] Date of Patent: May 21, 1991

[54] BREACH LOADING CARTRIDGE PEN

[76] Inventors: Andrew C. Peters, c/o Helix Engine Lane, Lyo Stourbridge, West Midlands DY9 7AJ, England; Anthony C. L. Wass, The Mousehole, Duddington, Stamford, Lincolnshire, both of England

[21] Appl. No.: 219,720

[22] Filed: Jul. 15, 1988

[30] Foreign Application Priority Data

Jul. 16, 1987 [GB] United Kingdom ..... 8716818

[51] Int. Cl.[5] ..... B43K 5/14

[52] U.S. Cl. ..... 401/132; 401/221

[58] Field of Search ..... 401/85, 89, 132–135, 401/77, 86, 221, 222, 86

[56] References Cited

U.S. PATENT DOCUMENTS

| | | | |
|---|---|---|---|
| 498,001 | 5/1893 | Bergen | 401/89 X |
| 1,495,664 | 5/1924 | Bergen | 401/89 X |
| 1,785,881 | 12/1930 | Tavenner | 401/85 X |
| 2,919,677 | 1/1960 | Mansheim | 401/135 X |

FOREIGN PATENT DOCUMENTS

| | | | |
|---|---|---|---|
| 375880 | 10/1939 | Italy | 401/132 |

*Primary Examiner*—Richard J. Apley
*Assistant Examiner*—D. F. Crosby
*Attorney, Agent, or Firm*—Bauer & Schaffer

[57] ABSTRACT

A cartridge refill pen is provided with a cartridge refill cavity which allows a cartridge to be laterally loaded into the pan. The cavity is opened and closed on relative rotational movement of interconnected generally tubular parts of the pen.

13 Claims, 5 Drawing Sheets

BREACH LOADING CARTRIDGE PEN

The invention relates to a pen and more particularly to a cartridge refill pen.

BACKGROUND OF THE INVENTION

Cartridge refill pens are well known but it is still believed that improvements are possible in the ease of use, production costs and manner of assembly.

It is an object of the present invention to provide a cartridge refill pen which is improved in at least some respect.

According to the present invention there is provided a cartridge refill pen which has a breech loading mechanism such that a cartridge can be laterally loaded into the pen.

SUMMARY OF THE INVENTION

The pen may be provided with a cartridge receiving cavity that can be opened and closed, preferably on relative rotation of two interconnected parts of the pen. Preferably, the interconnected parts are displaced axially towards or away from one another on said rotative rotation thereby automatically urging the cartridge to its correct position or allowing access to the spent cartridge.

In one embodiment of the present invention the interconnecting parts comprise an inner generally tubular part (which carries a nib unit) engageable (for example snap thread engagement) with an outer, generally tubular part. The two interconnected parts may be connected together by a driving dog and helical driving groove or thread arrangement. On relative rotation of said two parts the cartridge cavity is opened and closed and on closing of the cavity the cartridge may be automatically driven or pushed forwardly onto a penetration spike of the nib unit. Detent means may be provided to limit the relative rotation of said two parts to a particular angle and/or detent means may be provided to hold said two parts in the open and closed positions.

In a further embodiment of the present invention the pen comprises a first inner generally tubular part engaged with and extending axially from a second, outer tubular part. Said first and second parts are most preferably connected so that they are displaceable axially relative to one another by a generally linear force (to push the cartridge on the spike) before said two parts are rotated relative to one another to close the cavity. Therefore, an end of said first part may thus act as a push button. The first and second parts may be engaged together by a driving dog and groove, said groove having a variable axial extent to allow relative axial movement of said first and second parts on the application of a linear force when said first and second parts are at a particular relative angular orientation to one another and when said cavity is open. Such an arrangement allows the cartridge to be penetrated more easily than when penetration takes place solely during relative rotation of the first and second parts. Said second part may be screw threadably engaged with a third generally tubular part surrounding a nib unit of the pen. In this way the pen is utilisable with easily exchangeable nib units, which nib units themselves may be utilisable with standard pen barrels.

Further advantageous features of the pen will be apparent from the following description and drawings.

BRIEF DESCRIPTION OF THE DRAWINGS

Embodiments of a pen in accordance with the present invention will now be described, by way of example only, with reference to the accompanying drawings in which.

DESCRIPTION OF THE INVENTION

Figure 1:
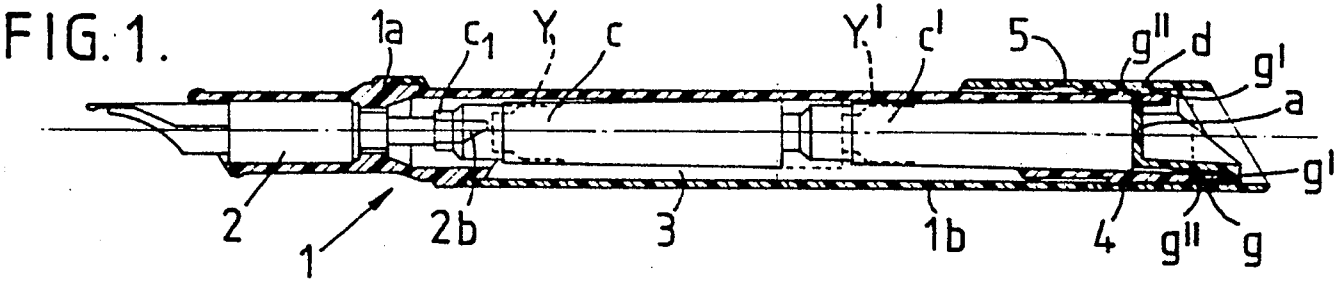
FIG. 1 shows a longitudinal sectional view of the first embodiment of the pen with first and second interconnected parts of the pen in a first relative rotational position in which a cartridge receiving cavity is closed off.

FIG. 1 shows a cartridge refill pen 1 having writing nib unit 2 which is generally of a known form per se and which has a hollow cartridge penetration spike 2*b* that penetrates one end $c_1$ of an ink cartridge C as it is driven or pushed towards the nib.

The pen 1 may generally be termed a breech-loading cartridge pen and consists basically of a first generally tubular part 1*a*, which holds the nib unit as shown in the FIGS. 1 to 5*b* of the drawings and which part 1*a* is interconnected to a second, outer generally tubular part 1*b*. Parts 1*a* and 1*b* are snap-engageable and rotatable relative to one another to open and close a receiving cavity 3 for the cartridge C and together parts 1*a* and 1*b* comprise a breech loading mechanism.

Tubular part 1*b* has an inner driving dog d which engages in a helical driving groove or thread g on an inner surface of part 1*a*. The groove g is designed for transmitting a high pressure in one direction only i.e. in a direction towards the nib unit 2 and the pressure flank g′ is perpendicular to the groove axis whilst the trailing flank g″ is inclined at 45°.

Figure 2:
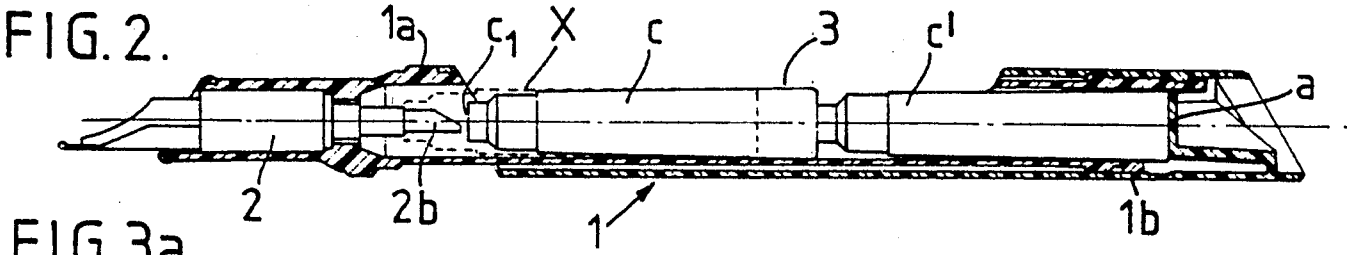
FIG. 2 shows a view similar to FIG. 1 with the first and second interconnected parts in a second relative rotational position in which a cartridge receiving cavity is open.

As shown in FIG. 2 the cartridge C has been introduced laterally into the cavity C, in this example, in front of another ink cartridge 3. On relative rotation of the interconnected parts 1*a* and 1*b*, the driving groove g drives the dog d in a generally forwards direction towards the nib unit 2. This, in turn, causes the abutment end a of the part 1*b* to urge cartridge C′, and thus also cartridge C, in the forwards direction towards the nib unit 2, until cartridge C occupies the general position X indicated by dashed lines in FIG. 2. Once the cartridge C occupies the general position X, the cavity 3 will be closed and the arrangement will be as depicted in FIG. 1. The dashed lines Y and Y′ in FIG. 1 represents the positions of the cartridges C and C′ respectively, before the cavity 3 is closed i.e. with parts 1*a* and 1*b* in their relative rotation position as shown in FIG. 2.

The breech loading cartridge pen 1 is convenient for several reasons more particularly because the first and second parts 1*a* and 1*b* do not have to be disconnected from one another before loading of the ink cartridge as in other designs. Therefore, parts 1*a* and 1*b* will not be lost from one another and a high pressure cartridge driving arrangement may be provided unlike in other designs in which the pen basically comprises a short nib holder for the nib unit which screws onto a longer tubular cartridge holder part which is closed off at one end.

A detent 4 is provided on the inner surface of part 1*a* spaced forwardly of the driving groove g and this is received in a groove 5 extending partway around the inner surface and defining two stop positions thereby limiting the relative angular rotation. Alternatively, such a groove need not be provided and the detent (or detents) may be arranged to 'click' into receiving slots on the inner surface of part 1*b*. Of course, if preferred, grooves or slots could be provided on part 1*a* which cooperate with detents on part 1*b*.

Figure 3A:
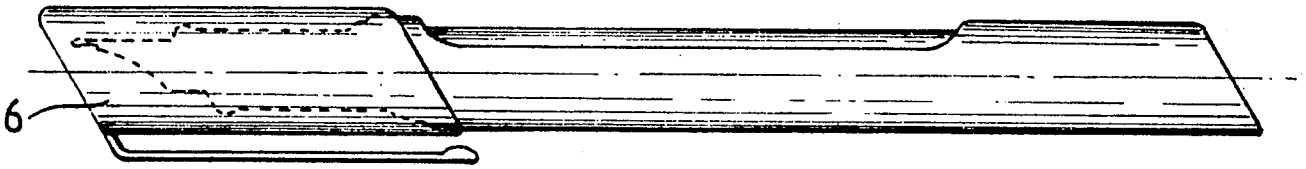
FIGS. 3*a* and 3*b* show outer elevational views of the pen with pen top disposed at each end of the pen respectively.
Figure 3B:
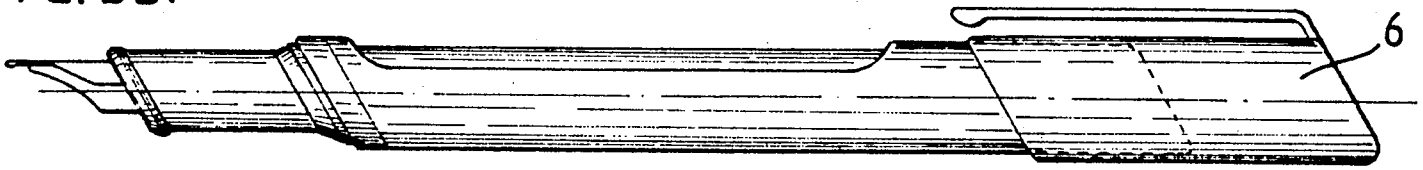

FIG. 3*a* shows an outside elevation of the pen with a pen top 5 secured in position at the left hand end of said figure in a manner which should be obvious and FIG. 3*b* shows the manner of securing the pen top to the other end of the pen (by a push fit) whilst the pen is in use and in order that the top is not lost. FIGS. 4*a*, 4*b*, 5*a*, 5*b* show modified arrangements for the pen top and retaining of same to the pen at opposed ends of the pen.

FIGS. 6 to 9 show further views of a second embodiment of the present invention.

Figure 6:
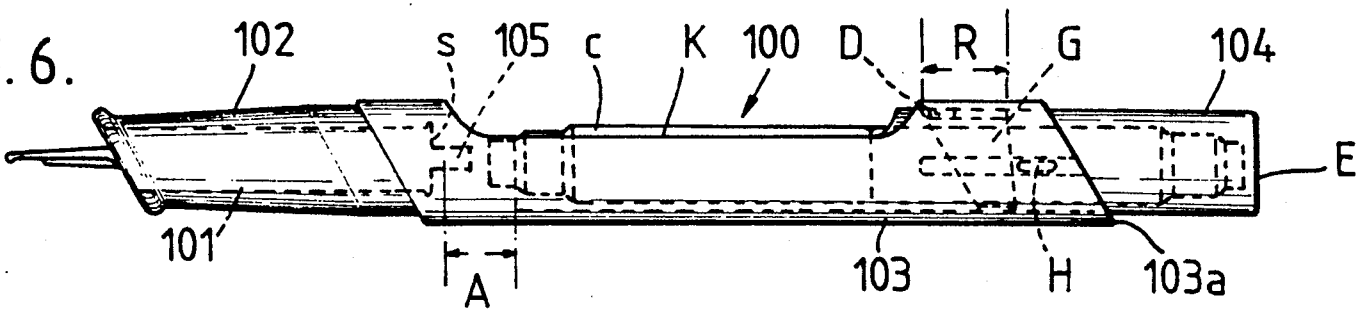
FIGS. 6 to 12 show views of further embodiments of the pen.
Figure 7:
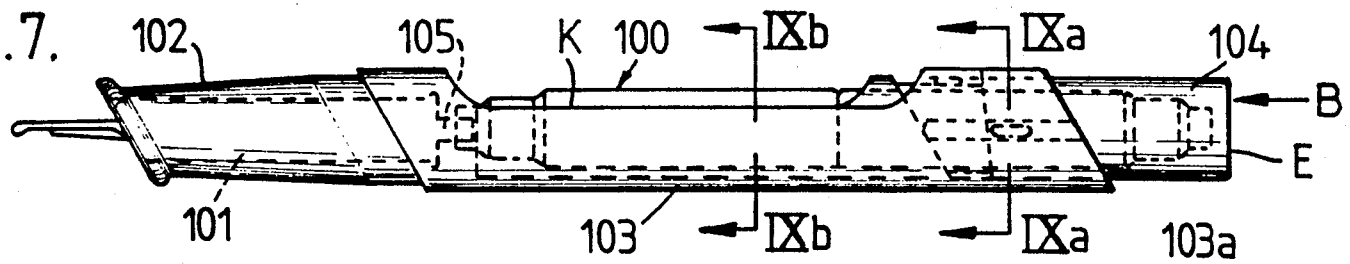

FIG. 6 is a view similar to FIG. 1 in which a cartridge pen 100 has a nib unit 101 received in a generally tubular part 102. Part 102 is integrally formed with generally tubular part 103 of wider diameter than part 102. The tubular part 103 receives an inner tubular part 104 (which extends axially therefrom) closed off at the end E remote from the nib unit 2. Part 102 is engaged with part 103 by insertion into the rearwardly open end 103*a* but is generally non-removable therefrom. The external surface of inner part 104 is formed with a driving groove G co-operable with driving dog D on an inner surface of part 103 as shown. However, the driving groove G is of variable axial extent around the circumference of part 104 and, therefore allows axial movement of the part 104 relative to part 103 (as groove G is moved in the direction of arrows R about dog D) in addition to rotation relative thereto. The axial movement of part 103 relative to part 104 is shown as A in FIG. 6. The amount of axial movement allowed by the groove G and dog D engagement upon the action of a linear force only is determined by the relative angular orientation of parts 103, 104. The maximum axial movement under linear force is readily seen in FIG. 6 with the axially widest part of the groove at the top of the FIGURE adjacent to the dog D.

Figure 8:
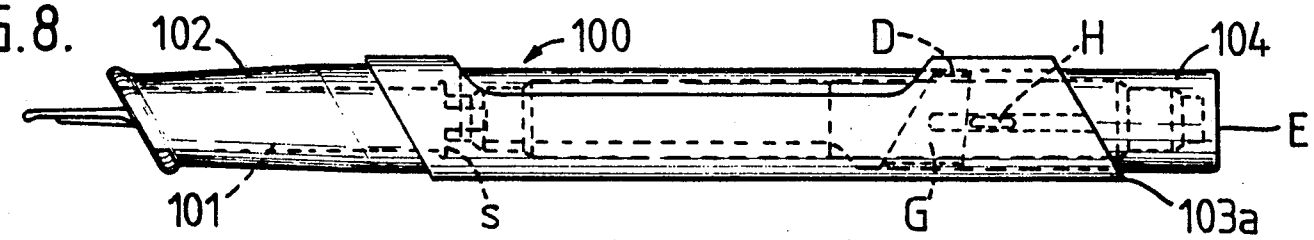
Figure 9B:
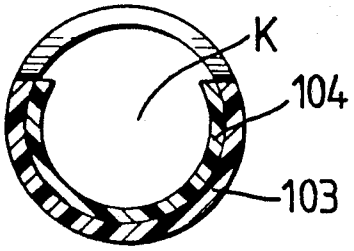
Figure 9A:
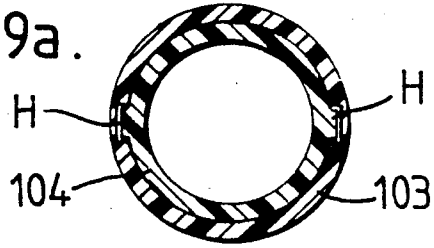

In the arrangement as shown in FIG. 6 cartridges have been loaded laterally into the open cavity K and unlike in the previous embodiment (FIGS. 1 to 6), the front cartridge can now be urged axially onto the piercing spike 105, and thus break the front end wall of the cartridge to allow access to the ink therein, without a relative rotational movement. With the cavity K open, part 104 may simply be pushed by pressing in end E in the direction of arrow B to pierce the cartridge (see FIG. 2). Part 104 is moved axially relative to part 103 on the application of a linear force because of the wide axial width of the groove located adjacent to the dog D when the cavity K is open. Part 104 can thus be said to provide a push button (end E) for piercing the front cartridge. Once the cartridge has been pierced, part 104 is rotated relative to part 103 to fully engage the cartridge in position and close the cavity K, by way of said co-operable dog D and groove G engagement. The front end of the cartridge engages a stop surface and has been pushed fully inwardly against the stop surface s in the position as shown in FIG. 8. FIGS. 9*a*, 9*b* show enlarged cross-sectional views of the pen taken on lines IXa—IXa and IXb—IXb of FIG. 7; part 104 can be rotated through 180° in either direction. A pair of diametrically opposed detent members H on the external surface of part 104 engage axial slots in part 103 to hold said parts 103, 104 in the open or closed positions of the cavity.

It has been found in practice with the arrangement shown in FIGS. 1 to 5*b* that a very strong driving groove and co-operable abutment needs to be provided for driving the front cartridge successfully onto the piercing spike on relative rotation of the interconnecting parts 1*a*, 1*b* of the pen. The arrangement shown in FIGS. 6 to 9 is a simpler arrangement in which the cartridge can, advantageously, be pierced more easily by a simple pushing action prior to effecting a relative rotational movement to close the cavity.

Figures 10, 11, 12:
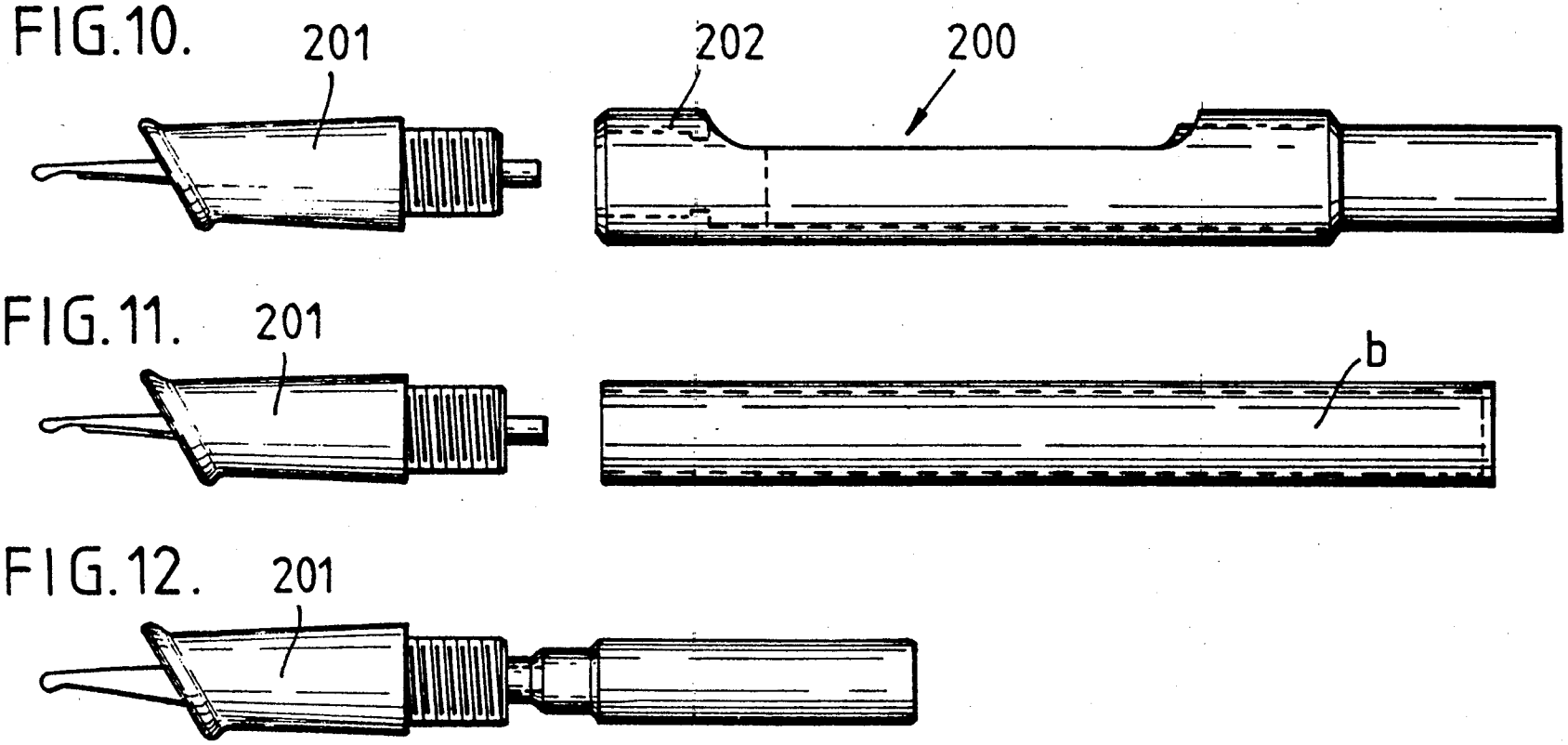
Figure 13:
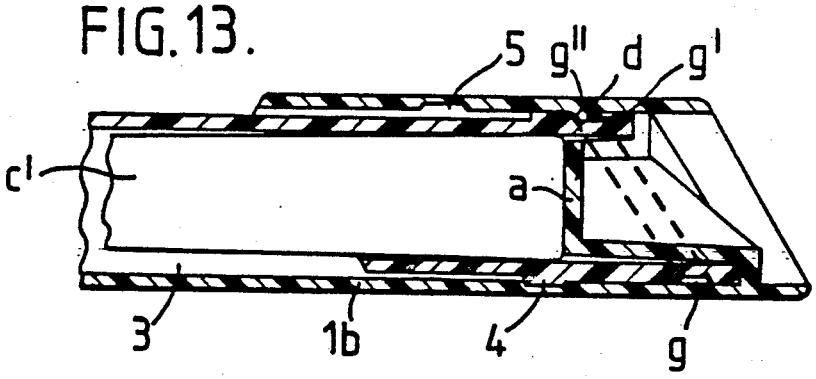
FIGS. 13 and 14 are enlarged detailed views of FIGS. 1 and 2, respectively, the dashed lines showing the groove.
Figure 14:
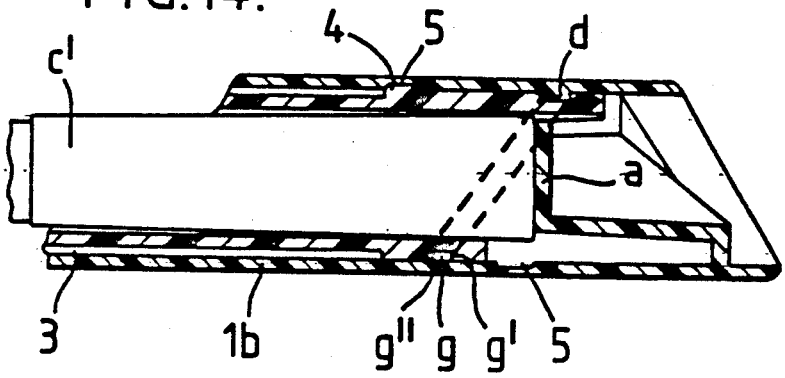
Figure 15:
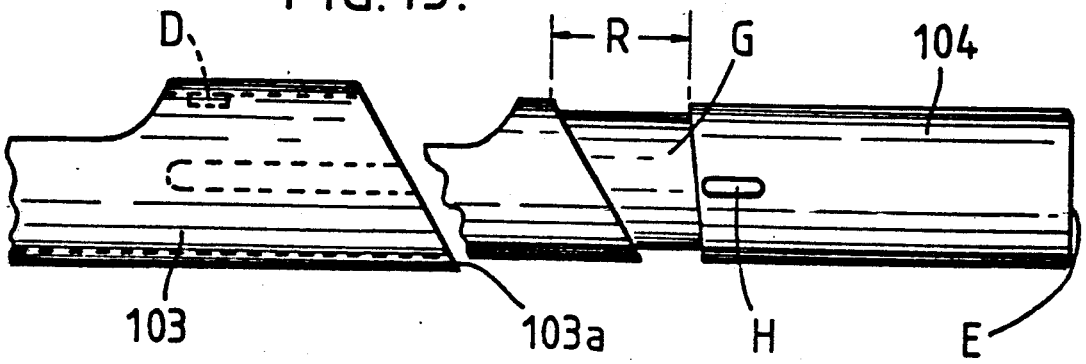
FIG. 15 is a detailed view of FIG. 6 before assembly of the parts, showing the different form of the groove G.

FIG. 10 shows a further embodiment of pen 200 which is similar to that shown in FIGS. 6 to 9 except that there is no part 101 is integrally formed with part 104. Instead, tubular part 201 has an external screw thread which engages an internal screw thread on part 202 and the same part 201 can also be used with a standard barrel b of a conventional barrel (see FIG. 11), thus providing a modular approach to manufacture of standard or breech-loading cartridge pens. The loading of cartridges into the pen 200 is exactly the same as in pen 100 and the front cartridge is driven onto the piercing spike in the same manner. Thus, the important difference is the threaded engagement which allows a variety of nib units (see FIG. 12) to be utilised with the breech loading concept (simply by unscrewing one nib unit and replacing it with another). Additionally, since part 200 is separable from part 201 parts of the pen may be cleaned more easily.

The scope of the present invention should not be unduly limited by the use of particular terminology and the scope of individual terms may extend to any convenient equivalent or generic term where sensible. Individual features of the pen or breech loading mechanism combinations thereof or function or methods relating thereto may be individually patentably inventive. The breech loading need not necessarily take place by relative rotation of the first and second parts, and the pen need not necessarily be designed to hold two ink cartridges simultaneously.

Therefore, according to a further aspect of the present invention there is provided a cartridge pen comprising a push button which may be actuated to push a cartridge onto a penetration spike of a nib unit of the pen.

By this aspect of the present invention the cartridge can be reliably and easily penetrated by said spike unlike in a standard cartridge pen where the action of screwing the barrel onto the nib unit provides the means for forcing the cartridge onto the penetration spike.

The provision of a suitable push or slide button in a cartridge pen to push the cartridge onto a pentration could, advantageously, be used in any general design of cartridge pen and not necessarily only with the breech loading cartridge pen as aforedescribed.

Figures 4A, 4B, 5A, 5B:
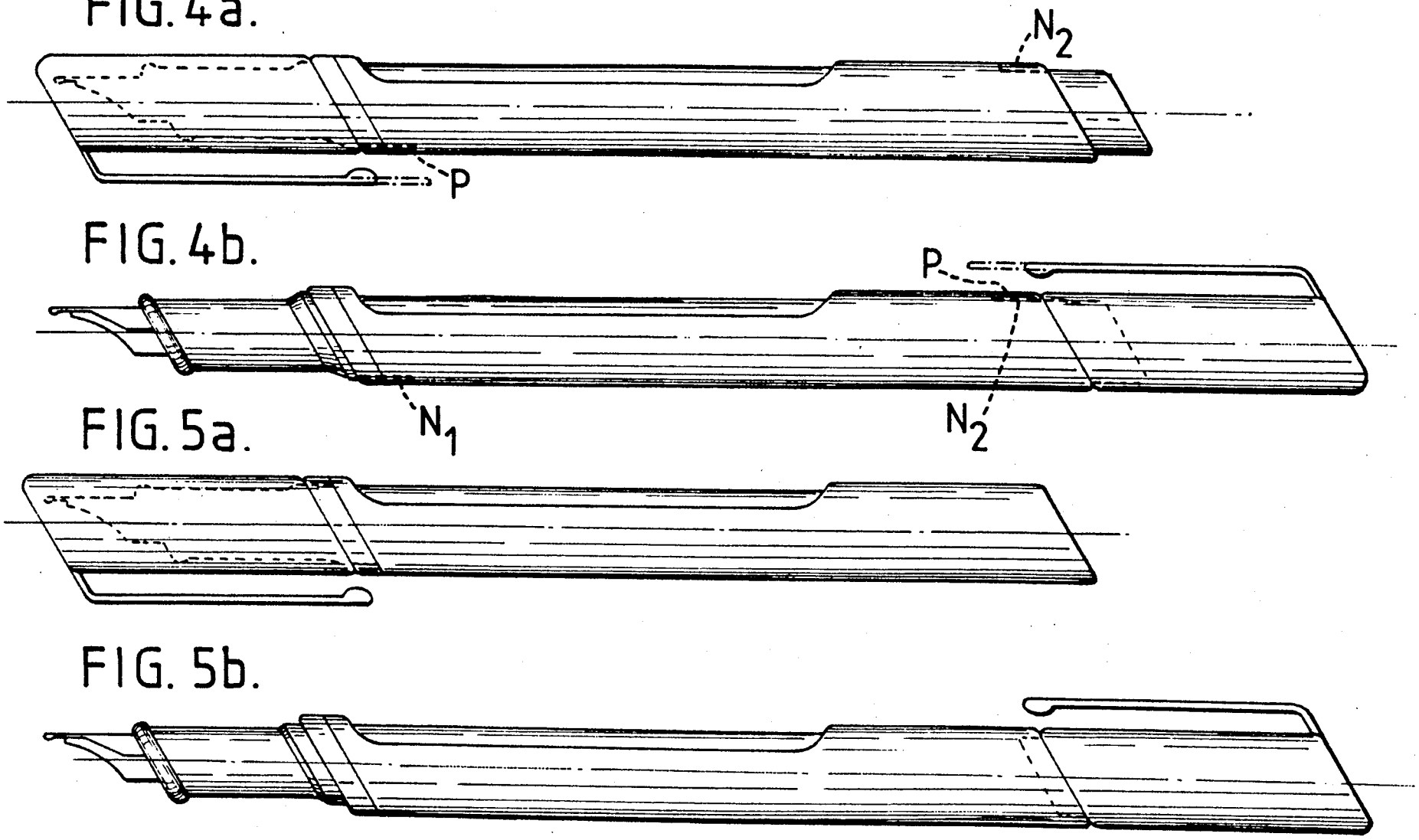
FIGS. 4*a*, 4*b*, 5*a*, 5*b* show outer views similar to FIGS. 3*a*, 3*b* in which the pen top has been modified.

FIGS. 4*a* and 4*b* show additional possible modifications to the pen design which have not been previously discussed. These modifications relate to the more positive location of the pen top on either end of the pen in a manner which substantially prevents relative rotation of the pen top while said top is in a particular relative axial location on the pen. FIGS. 4*a* and 4*b* show the pen top being provided with a spike projection P having one external contour conforming to the external contour of the pen. The projection P fits neatly into a first notch $N_1$, when the top is located at the nib unit end of the pen, thus restraining relative rotation of the top on the pen, until the projection is freed from the notch by suitable relative axial movement of the top and pen. In a similar manner, the projection P can engage notch $N_2$ when the top is attached to the opposite end of the pen and in a similar manner, when the projection P engages notch $N_2$ relative rotation of the pen and top is restrained. Additionally, projection P may be used as a tool to prise out cartridges from the cartridge cavity or to prise a cartridge from the penetration spike. Alternatively, if the projection/notch arrangement P, $N_1$, $N_2$ is not provided and a prising tool is still required the end of the pen top clip may be lengthened and suitably shaped to provide such a tool (see the chain dotted lines on the pen top clip in FIGS. 4*a* and 4*b*).

If the pen top is not provided with a spike projection P, then the annular inclined surfaces on the pen which are respectively engageable by the similarly inclined annular surface of the pen, act as cams so that, on relative rotation of the top and pen, the pen top may be easily removed, due to the camming action providing relative axial displacement of the top.

We claim:

1. A pen employing a fluid refill cartridge comprising a barrel having a writing nib at one end, said barrel comprising an inner holder having a cavity for receiving a refill cartridge and a cylindrical cover disposed over said holder, said cover having an opening in its side conforming to an opening of the cavity in said holder, said holder and said cover having interconnecting means permitting relative rotation between an open position wherein said opening is aligned with said cavity to permit lateral loading of the refill cartridge, and a closed position occluding said cavity to retain the refill cartridge therein.

2. The pen according to claim 1, wherein said nib is provided with means for piercing the end of said refill cartridge, and said interconnecting means is provided with cooperating means for moving said nib and refill cartridge axially relatively toward and away from each other.

3. The pen according to claim 2, wherein said holder and cover are displaceable axially relative to one another with a generally linear force in order to push the cartridge into the means for penetrating said cartridge before said holder and cover are rotated relative to one another to close the cavity.

4. The pen according to claim 3, wherein said interconnecting parts are engaged together by driving dog and groove, said groove having an axial and circumferential extent which allows relative axial movement of said holder and cover on the application of a linear force when said holder and cover are at a particular relative angular orientation to one another and when said cavity is open.

5. The pen according to claim 4, wherein said cover is screw threadably engaged with a generally tubular part surrounding the nib.

6. The pen according to claim 2, wherein the interconnecting means comprises a driving dog and helical driving groove or thread arrangement.

7. The pen according to claim 6, wherein detent means is provided to limit the relative rotation of interconnected holder and cover predetermined angle.

8. The pen according to claim 7, including detent means for holding said two parts in the open and closed positions.

9. The pen according to claim 2, wherein the holding is generally tubular and extends axially from the outer cylindrical cover.

10. A cartridge refill pen comprising an outer pen barrel having a side opening and receiving an inner tubular part, the arrangement being such that the inner tubular part can be rotated relative to the outer pen barrel in order to open and close the side opening in the outer barrel through which the cartridge can be laterally loaded into a cartridge receiving cavity in the pen.

11. A pen as claimed in claim 10, wherein said side opening comprises a slot which is alignable with a slot in the inner tubular part to allow access to the cavity.

12. A cartridge refill pen comprising an outer pen barrel supporting a nib unit, said pen barrel having a side entrance to a cartridge receiving cavity in the pen and a entrance cover by which said side entrance can be opened and closed to allow direct side access into the pen barrel for loading a cartridge or for removing a spent cartridge.

13. The pen according to claim 12 in which said entrance cover comprises a tubular member located within said pen barrel.

* * * * *